United States Patent [19]

Gould

[11] 4,300,246

[45] Nov. 17, 1981

[54] POOL CLEANING HEAD

[75] Inventor: Henry D. Gould, Phoenix, Ariz.

[73] Assignee: Shasta Industries, Inc., Phoenix, Ariz.

[21] Appl. No.: 157,118

[22] Filed: Jun. 6, 1980

[51] Int. Cl.[3] ..... E04H 3/20

[52] U.S. Cl. ..... 4/490; 134/167 R; 134/168 R

[58] Field of Search ..... 4/490; 134/167 R, 111, 134/168 R, 10

[56] References Cited

U.S. PATENT DOCUMENTS

| | | | |
|---|---|---|---|
| 3,449,772 | 6/1969 | Warner | 4/490 |
| 3,506,489 | 4/1970 | Baker | 4/490 X |
| 3,521,304 | 7/1970 | Ghiz | 4/490 |
| 4,114,206 | 9/1978 | Franc | 4/490 |

*Primary Examiner*—Henry K. Artis

*Attorney, Agent, or Firm*—Cahill, Sutton & Thomas

[57] ABSTRACT

A cleaning head for connection at bottom surfaces of a swimming pool to an automatic pressure control system includes a chamber and a rotary expansion collar disposed in the chamber. The collar has relatively thin cylindrical walls and an inclined slot extending through the cylindrical wall, allowing the collar to expand in response to increased water pressure produced by the pressure control system. The slot is closed when the collar is relaxed and is opened in response to water being forced under high pressure into an interior portion of the chamber surrounded by the collar. Water ejected from the interior portion through the open slot causes the collar to rotate. As the water pressure increases, the collar expands further until its outside surfaces frictionally engage the chamber wall, stopping rotation of collar. As the water pressure is cycled between zero pressure and a high pressure, the directions of jets of water exhausted through the inclined slot are randomly varied, causing cleaning of a circular portion of the swimming pool surface located around the cleaning head.

9 Claims, 7 Drawing Figures

POOL CLEANING HEAD

BACKGROUND OF THE INVENTION

1. Field of the Invention

The invention relates to swimming pool cleaning systems including rotary devices which eject jets of water along bottom surfaces of a swimming pool to agitate settled debris on the bottom of the swimming pool.

2. Description of the Prior Art

A great deal of effort is required to keep swimming pool surfaces clean. A variety of rotary devices (referred to as "cleaning heads") which eject high pressure water jets along bottom surfaces of swimming pools as water pressure to the cleaning heads is "cycled" are known. One such cleaning head is disclosed in U.S. Pat. No. 3,408,006. However, that device has a number of serious shortcomings. It is unduly complex and expensive. Furthermore, due to its complexity, it is less reliable than is desired for a swimming pool which requires a large number of cleaning heads. Another device, which is much less expensive than the device disclosed in U.S. Pat. No. 3,408,006, is described in my U.S. Pat. No. 4,200,230, incorporated therein by reference.

It is an object of the invention to provide an improved rotary swimming pool cleaning head device which is less complex both in construction and in operation than any previous rotary swimming pool cleaning device.

It is another object of the invention to provide a rotary swimming pool cleaning device which is less expensive than prior swimming pool cleaning heads.

A high degree of reliability is essential for any rotary swimming pool cleaning head utilized in large swimming pools, because the number of rotary devices required can be in excess of 15 for many large modern swimming pools. When such a large number of cleaning heads are required in a single pool, a high degree of reliability is required in order to avoid the inconvenience and expense of the frequent repairs which would be required if reliability of the cleaning heads were not high.

It is therefore another object of the invention to provide a low cost rotary cleaning device which is substantially more reliable than any previous rotary swimming pool cleaning head.

SUMMARY OF THE INVENTION

Briefly described, and in accordance with one embodiment thereof, the invention provides a device for automatically cleaning swimming pool surfaces, wherein the device includes a base connected to an automatic water pressure system, a cover attached to the base unit, the cover on the base unit bounding an interior chamber having an opening through which water from the automatic pressure system is forced into the chamber, a rotating expansion collar disposed in the chamber surrounding a region into which water from the opening is forced by the automatic pressurized water system, an inclined slot in the wall of the collar opening in response to pressurized water to eject a jet of water, causing rotation of the rotating collar until the water pressure expands the collar sufficiently that it frictionally engages the walls of the chamber, stopping the rotation.

In the described embodiment of the invention, a receptacle is permanently mounted approximately flush with the bottom of the swimming pool and extends to sealably engage a pipe leading to the water pressure control system. The base unit can be inserted into the receptacle and locked thereto by means of a pair of pegs extending from the receptacle walls and corresponding slots in the walls of the base. A disc-shaped cover includes a plurality of spaced, approximately radial dividers on its lower surface. When the cover is attached to the upper surface of the base, the chamber, cylindrical in shape, is formed, a plurality of radial ports being bounded by the spaced dividers. The expansion collar rotates freely in the chamber, due to ejection of the jet of water. The opening in the lower portion of the base is surrounded by the cylindrical wall of the collar, the upper edge of the collar being adjacent to the cover and the lower edge of the collar being adjacent to the portion of the base surrounding the opening in the base. In the described embodiment of the invention, the rotating collar, receptacle, base and cover are made of suitable plastic, such as PVC or other durable abrasion-resistant plastic. The thickness of the collar adjacent to the inclined slot is sufficient to direct the ejected jet of water roughly tangentially to the cylindrical walls of the collar. The thickness of the opposite side of the cylindrical wall is selected to provide the resilience necessary to cause the outer walls of the collar to frictionally engage the inner walls of the chamber at a desired water pressure.

DESCRIPTION OF THE INVENTION

Figure 2:
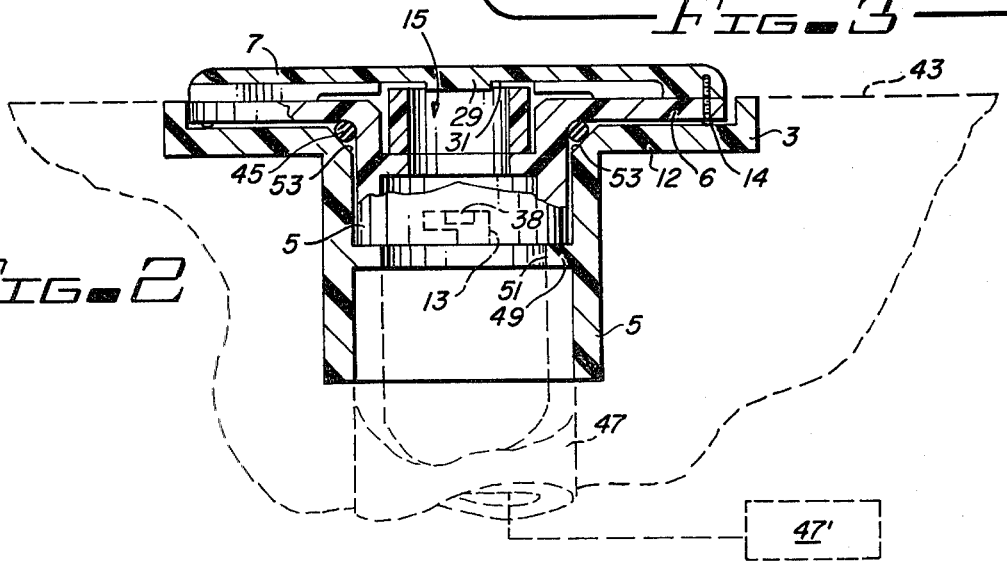
FIG. 2 is a sectional view taken along section line 2—2 of FIG. 1.
Figure 5:
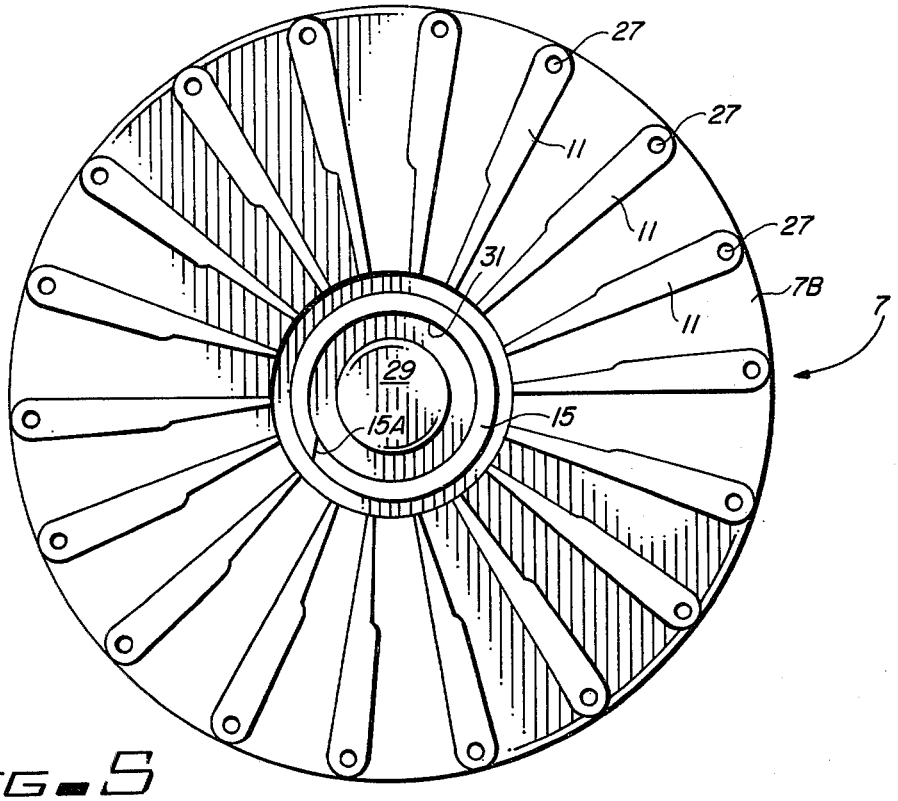
FIG. 5 is a plan view of the bottom of the cover shown in FIG. 3.

Referring now to the drawings, pool cleaning head 1 includes a receptacle 2 having a lower portion 5 and an upper portion 3. As best seen in FIG. 2, lower portion 5 (which may be composed of PVC) is sealably connected to a pipe 47. Pipe 47 is connected to water pressure control system 47' (indicated by dotted lines) which alternately turns water pressure to pool cleaning head 1 on and off, as subsequently described. Receptacle 2 is mounted along a horizontal swimming pool surface 43 so that the upper edge of upper portion 3 of receptacle 2 is flush with pool surface 43. Pool surface 43 can be either at the bottom of the swimming pool or can be any other horizontal surface, such as a step surface or love seat surface, in the swimming pool. An interior rim 49 disposed within bottom portion 5 of receptacle 2 functions as a seat against which the upper edge of pipe 47 rests. Rim 49 also functions as a seat against which base 6 of the swimming pool head rests.

Figure 3:
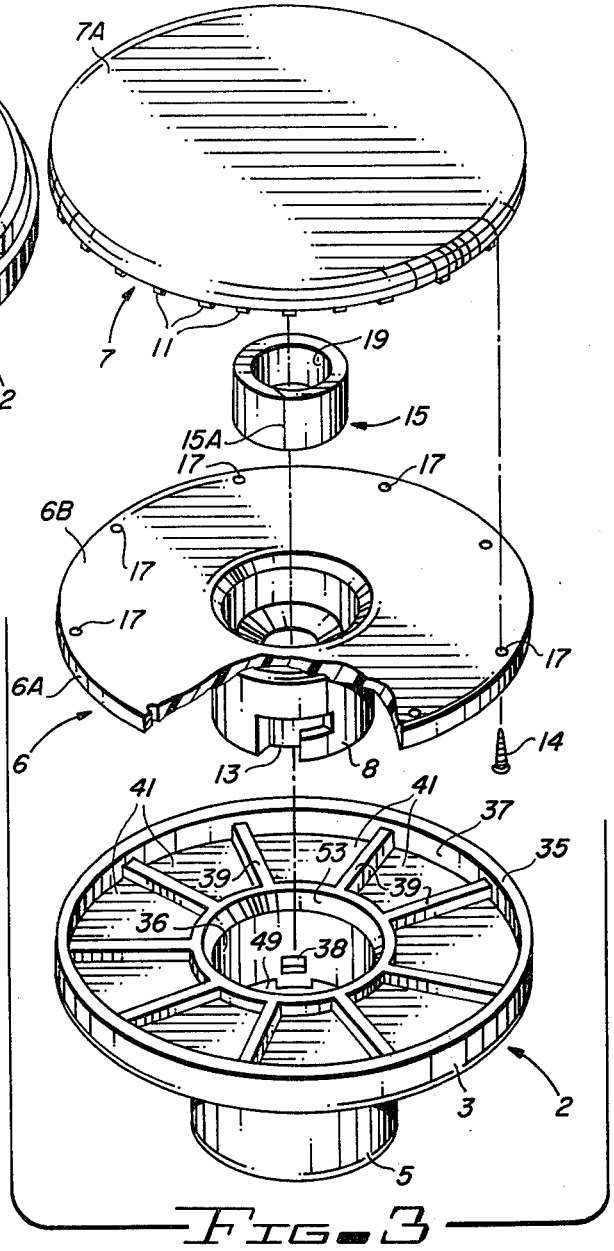
FIG. 3 is an exploded, partial cutaway view of the swimming pool cleaning head of the present invention.

Base 6 is removably inserted into receptacle 2. As best seen in FIG. 3, base 6 includes a trunk portion 9 having a pair of opposed locking slots 13 which mate with corresponding ones of a pair of opposed pegs 38 disposed in the interior surface of lower portion 5 of receptacle 2. Base 6 also includes a disk-shaped upper plate 6A having a flat upper surface 6B. A recess 25 is formed centrally in the upper surface of upper plate 6A. A hole 21, having a smaller diameter than that of recess 25, extends through trunk 8. A horizontal annular surface 23 surrounds hole 21.

Figure 4:
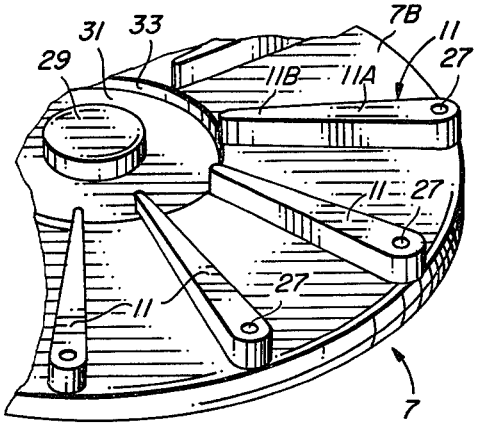
FIG. 4 is a partial perspective bottom view of the cover shown in FIG. 3.

Cover 7 includes a top surface 7A, as shown in FIG. 3. Cover 7 also includes a plurality of approximately, but not exactly, radial space dividers 11 on its bottom surface 7B, as best seen in FIG. 4. A recess 33 formed in bottom surface 7B has an annular surface 31 surrounding a central cylindrical post 29. Each of dividers 11 includes an outer portion 11A and a tapered inner portion 11B. As subsequently described, inner portions 11B are not precisely radial with respect to the center of disk-shaped cover 7, but instead are oriented to efficiently receive water ejected through inclined slot 15A of rotary collar 15. Cover 7 is attached to base 6 by means of a plurality of screws 14, which extend through hole 17 of base 6 and into holes 27 of cover 7.

Figure 6A:
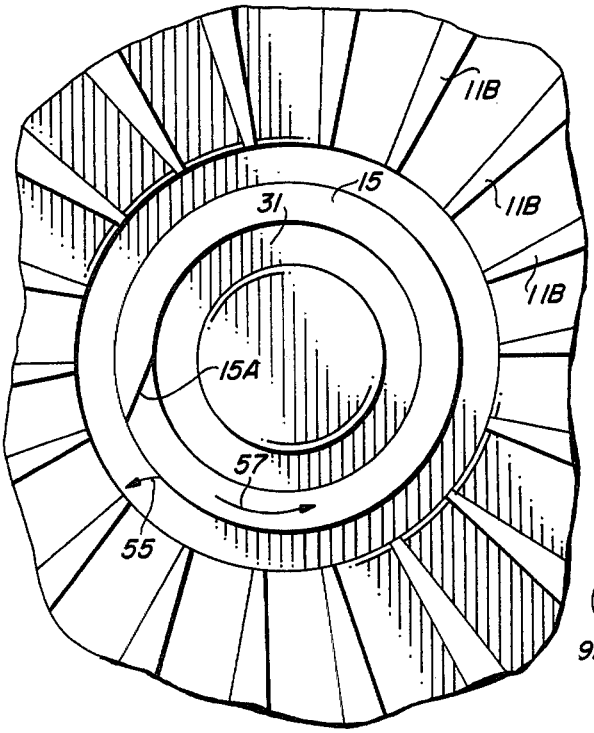
FIGS. 6A and 6B are partial bottom views of the cover and rotary collar shown in FIG. 3, and are useful in explaining the operation of the swimming pool cleaning head.
Figure 6B:
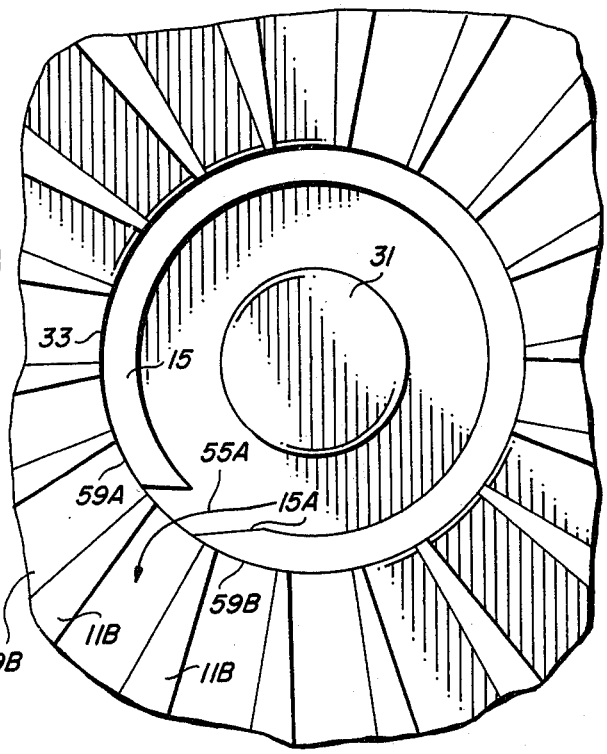

Referring now to FIG. 3, rotary collar 15 includes a relatively thin cylindrical wall bounding a region indicated by reference numeral 19. Slot 15A is inclined with respect to the wall of rotating collar 15, and is approximately tangent to the inner cylindrical wall surface of collar 15. Slot 15A therefore is hereinafter referred to as "inclined slot" 15. Water forced from pipe 47 (FIG. 2) through hole 21 passes into the region bounded by rotating collar 15 and the lower surface of cover 7. The lower edge of collar 15 rides on annular horizontal surface 23. The height of collar 15 is selected so that collar 15 is capable of freely rotating within the chamber formed by cover 7 and base 6. However, the tolerance therebetween is sufficiently small that practically all water forced into the region 19 is approximately tangentially ejected from collar 15 through inclined slot 15A. Inclined slot 15A initially is closed, but expands, due to the elasticity of collar 15, as the water pressure in pipe 47 is increased. The tangential ejection of water through inclined slot 15A causes collar 15 to rotate in the direction indicated by arrow 57 in FIG. 6A. The inside diameter of recesses 33 and 25 and the outside diameter of rotating collar 15 and the elasticity of rotating collar 15 are selected so that when the water pressure reaches a determined level, for example, approximately 4 pounds per square inch, collar 15 has expanded so that its outer walls frictionally engage the inner walls of the one of recess 33 or recess 25 having the smaller diameter, causing rotation in the direction indicated by arrow 57 to stop. This condition is illustrated in FIG. 6B wherein it is seen that the outer surface of rotating collar 15 has frictionally engaged the wall of recess 33, and therefore has stopped rotating. At this point, slot 15A has reached its maximum width.

Figure 1:
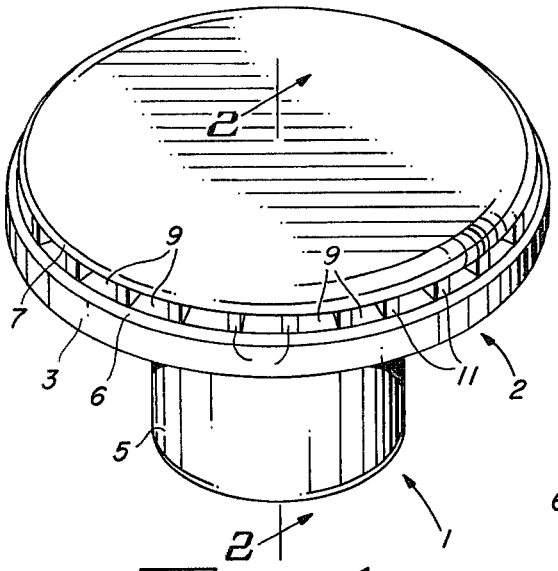
FIG. 1 is a perspective view of the swimming pool cleaning head of the present invention.

The purpose of providing tapered divider portions 11B at angles which are nonradial with respect to the center of cover 7 is to cause the "port" regions 9 (FIG. 1) between the individual dividers 11 to be as closely aligned as possible with water ejected from the open inclined slot 15A, thereby minimizing turbulence and friction of ejected water with the sides of dividers 11. This results in more powerful jets of water being ejected out of the various ports 9, and consequently results in improved cleaning action along the circular portion of swimming pool surface 43 which surrounds cleaning head 1.

It can be readily seen that no "indexing" (as shown in the previously mentioned prior art patents) is involved in determining precisely where collar 15 stops rotating when it frictionally engages walls of the chamber formed by recesses 25 and 33. The open slot may, in some instances, be aligned mainly with one port, such as 9A in FIG. 6. In other instances, slot 15A may be aligned so that water is ejected from two adjacent ports.

In this case, the strength of the ejected steam of water will be less than if the entire ejected steam of water is exhausted from a single outlet port. However, the automatic pressure control system to which the pipe 47 (FIG. 2) is connected should be adjusted to "cycle" every 10 to 20 seconds. Each time that the pressure from control system 47' (FIG. 1) is turned off and on, collar 15 rotates to a new random position. Due to the large number of pressure cycles, there will be a sufficiently large number of times when slot 15A is nearly perfectly aligned with the various outlets ports 9 that after several hours, the circular areas surrounding each swimming pool head installed in a swimming pool will be well cleaned.

Referring to FIG. 2, it can be seen that a rubber ring 45 fits between the right angle corner between top portion 6A and trunk portion 8 of base 6 and an inclined surface 53 of receptacle 2 (FIG. 3). Rubber ring 45 functions as a gasket which prevents any of the high pressure water in pipe 47 from leading between base 6 and receptacle 2.

In the described embodiment of the invention, the thickness of the walls of collar 15 is approximately one eighth of an inch. The height of the dividers 11 is approximately one eighth of an inch. The device having a rotating collar 15 with an outside diameter of approximately one inch, a wall thickness of approximately one eighth of an inch, and a height of approximately one-half inch, and having relative dimensions generally shown by the drawings, ejects high pressure water jets which conduct approximately four to five gallons of water per minute at a water pressure of approximately 28 pounds per square inch. It has been found that if control system 47' utilizes a water control valve manufactured by G E & D Company, 2002 W. Ironwood, Phoenix, Ariz., having a "turn on" time of approximately two to four seconds, collar 15 rotates approximately 40 degrees each time the water pressure is cycled. The thickness of the portion of the wall opposite the slot 15A was "trimmed" somewhat in order to provide sufficient resilence that outer walls of collar 15 engage the walls of recesses 33 and 25 when the water pressure is approximately four pounds per square inch. It should be noted that the spacers 39 indicated by reference numeral 41 in FIG. 3 provide a satisfactory degree of strength for portion 3 of receptacle 2, while minimizing the amount of plastic material required to fabricate receptacle 2. The various parts of cleaning head 1 can be made of suitable, durable, wear-resistant plastic such as PVC (polyvinyl chloride) or DELRIN plastic.

While the invention has been described with reference to a particular embodiment thereof, those skilled in the art will be able to make various modifications to the disclosed structure without departing from the true spirit and scope of the invention, as set forth in the appended claims.

I claim:

1. A device for automatically cleaning swimming pool surfaces, said device being adapted for use in a swimming pool cleaning system including a high pressure source which cycles water pressure applied to said device, said device comprising in combination:

a base, said base having an upper surface, a recess in said upper surface, and an opening for conducting water from said high pressure source into said recess;

a cover, said cover being connected to said base to form an interior chamber bounded by said recess and a plurality of outlet ports disposed peripherally about said chamber for conducting jets of water outwardly from said device along an inner surface of said swimming pool; and rotating means disposed in said chamber for receiving water forced into said chamber from said high pressure source and guiding water into various ones of said outlet ports as water pressure from said high pressure source is cycled, said rotating means rotating in response to water ejected non-radially from said rotating means, said rotating means expanding in response to pressure of water forced through said chamber to frictionally engage the walls of said chamber, randomly stopping rotation of said rotating means as the water pressure is cycled.

2. The device of claim 1 wherein said rotating means includes a cylindrical collar having an inclined slot therein, said inclined slot having surfaces which are approximately tangential to the inner surface of said cylindrical collar.

3. The device of claim 2 wherein the diameter of said collar is greater than a diameter of said opening, said opening extending through said base into said chamber for conducting water into said chamber from said high pressure source.

4. The device of claim 3 wherein said base includes a disk-shaped plate having a flat upper surface and a cylindrical trunk attached to the bottom of said plate, said opening extending through said trunk.

5. The device of claim 4 wherein said cover includes a disk-shaped plate having a lower surface having a recess therein and a plurality of spaced dividers extending outwardly from said recess, said dividers being non-radial by an amount sufficient to reduce turbulence and friction of water ejected from said inclined slot.

6. The device of claim 1 further including a receptacle for receiving the trunk of said base, said receptacle being permanently attached to a high pressure water pipe disposed beneath the surface of said pool, the upper edge of said receptacle being approximately flush with the surface to be cleaned of said pool.

7. The device of claim 6 further including locking means for allowing said base unit to be removably and sealably engaged with said receptacle unit.

8. The device of claim 7 wherein said first and second recesses are aligned when said cover is attached to said base, said first and second recesses being cylindrical and having substantially the same diameter.

9. The device of claim 1 wherein the portion of said collar adjacent to said slot is thicker than another portion of said collar, the thickness of said other portion being selected to cause said collar to partially engage the walls of said chamber at a predetermined water pressure.

* * * * *